US007774881B2

(12) United States Patent
Friedrichs

(10) Patent No.: US 7,774,881 B2
(45) Date of Patent: Aug. 17, 2010

(54) RECLINING MEANS

(76) Inventor: Arno Friedrichs, Grünbaum 3, D-95326 Kulmbach (DE)

( * ) Notice: Subject to any disclaimer, the term of this patent is extended or adjusted under 35 U.S.C. 154(b) by 10 days.

(21) Appl. No.: 12/223,543

(22) PCT Filed: Jan. 30, 2007

(86) PCT No.: PCT/EP2007/050891

§ 371 (c)(1),
(2), (4) Date: Aug. 1, 2008

(87) PCT Pub. No.: WO2007/099007

PCT Pub. Date: Sep. 7, 2007

(65) Prior Publication Data

US 2009/0013475 A1 Jan. 15, 2009

(30) Foreign Application Priority Data

Feb. 24, 2006 (DE) ..... 10 2006 008 598

(51) Int. Cl.
*A27C 27/10* (2006.01)

(52) U.S. Cl. ..... 5/713; 5/710

(58) Field of Classification Search ..... 5/710–713, 5/600

See application file for complete search history.

(56) References Cited

U.S. PATENT DOCUMENTS

| | | | | |
|---|---|---|---|---|
| 3,879,776 | A | 4/1975 | Solen | |
| 4,542,547 | A | 9/1985 | Sato | |
| 5,182,826 | A | 2/1993 | Thomas et al. | |
| 5,829,081 | A | 11/1998 | Pearce | |
| 5,873,137 | A | 2/1999 | Yavets-Chen | |
| 6,108,843 | A * | 8/2000 | Suzuki et al. | 5/713 |
| 2003/0195644 | A1 * | 10/2003 | Borders et al. | 700/90 |
| 2004/0101146 | A1 * | 5/2004 | Laitinen et al. | 381/77 |
| 2008/0086821 | A1 | 4/2008 | Friedrichs | |
| 2008/0249378 | A1 * | 10/2008 | Brauers et al. | 600/301 |

FOREIGN PATENT DOCUMENTS

| | | |
|---|---|---|
| DE | 696 11 490 | 8/2001 |
| DE | 20 2004 000 701 | 6/2004 |
| DE | 10 2004 041 996 | 3/2006 |
| EP | 0 698 361 | 2/1996 |
| EP | 0 757 899 | 2/1997 |
| EP | 1 543 748 | 6/2005 |
| FR | 2 873 215 | 1/2006 |
| GB | 2 168 893 | 7/1986 |
| WO | WO 00/03628 | 1/2000 |
| WO | WO 2005/104904 | 11/2005 |

OTHER PUBLICATIONS

International Search Report.

* cited by examiner

*Primary Examiner*—Fredrick Conley
(74) *Attorney, Agent, or Firm*—Collard & Roe, P.C.

(57) ABSTRACT

The invention relates to a reclining means which has a mattress with a multiplicity of air chambers arranged in lattice form. Also provided is a mattress-profile memory which stores, for each of the air chambers, valve-control data corresponding to a mattress profile. The reclining means also has a data-carrier holder, into which a data carrier can be inserted, and means for writing valve-control data into a data carrier inserted into the data-carrier holder, as well as means for reading valve-control data which are stored on a data carrier inserted into the data-carrier holder.

7 Claims, 4 Drawing Sheets

RECLINING MEANS

Figure 1:
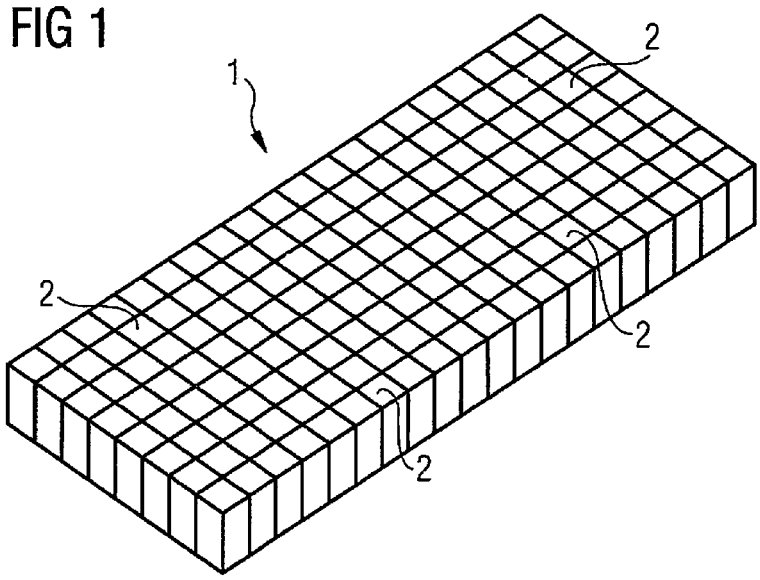

The invention relates to lying-down means.

Inflatable lying-down means are already known. A simple form of lying-down means of that kind is an air mattress. This has a single air chamber or multiple air chambers able or each able to be filled with air by way of a respective air connection, for example with use of a compressor. The respective air connection is closed by means of a plug after filling of the associated air chamber.

A mattress-cushion, which can be filled with compressed air, for an item of furniture for lying on is known from DE 20 2004 000 701 U1, the mattress-cushion being chargeable with compressed air by way of a compressor. At least one, preferably three, additional independent air chambers are provided on the upper side of the mattress-cushion in the region of the anticipated spinal curvature of the sleeping person. The air chambers extend over the entire width of the mattress-cushion. Each air chamber has a connection for a compressor so that each air chamber can be individually charged with compressed air.

A mattress with a firmness able to be regulated by the user is known from DE 696 11 490 T2. The mattress consists of a core with a structure consisting of a lined layer on each side and an upholstered layer similarly on each side. At least one of the lined layers is a reticular body usually with a prismatic-rectangular construction. The structure is based on a laminated-wall body subdivided by several transversely extending separations defining the mutually adjacent, transversely extending sealed air chambers. Each air chamber can be individually inflated so that depending on the respective pressure with which the transversely extending chambers of the reticular body were provided this body can have different degrees of firmness. In addition, a compressor installation is provided which is supported by an air reservoir and supplies the transversely extending air chambers with pressure by way of independently and individually controllable electric valves.

A lying-down means is described in DE 10 2004 041 996.5, which comprises a mattress with a plurality of air chambers in grid arrangement. These are each provided with at least one air connection. In addition, a plurality of controllable valve is present, each valve being associated with one of the air chambers. Moreover, a plurality of sensors is provided. A control unit is connected with the sensors. The control unit controls the valves in dependence on valve control data, which are stored in a mattress profile memory and which correspond with a mattress profile, when this mattress profile was selected by means of an operating unit with additional consideration of the output signals of the sensors.

The invention is based on the object of indicating lying-down means in which the setting of a desired mattress profile is simplified.

This object is fulfilled by lying-down means with the features indicated herein. Advantageous refinements and developments of the invention are also disclosed. A data carrier for use in the data carrier receptacle of the lying-down means is also disclosed. A mobile communications apparatus which can be contacted with the data interface of the lying-down means is also disclosed.

The advantages of the invention particularly reside in the fact that a user, who is the actual owner of lying-down means according to the invention, has the possibility of transferring the valve control data of a mattress profile, which is personally preferred by him or her, in wire-free manner to a data carrier via mobile communications apparatus and to carry this carrier or apparatus with him or her. This makes it possible for the user, for example on the occasion of overnighting in hotels, stays in hospitals, stays at health resorts and also private visits, to quickly and rapidly input into lying-down means, which are provided there and are similarly provided with the features according to the invention, the valve control data of the mattress profile personally preferred by the user. This provides him or her with a substantial saving in time, since a laborious and time-consuming manual setting of the mattress profile is not necessary.

Figure 2:
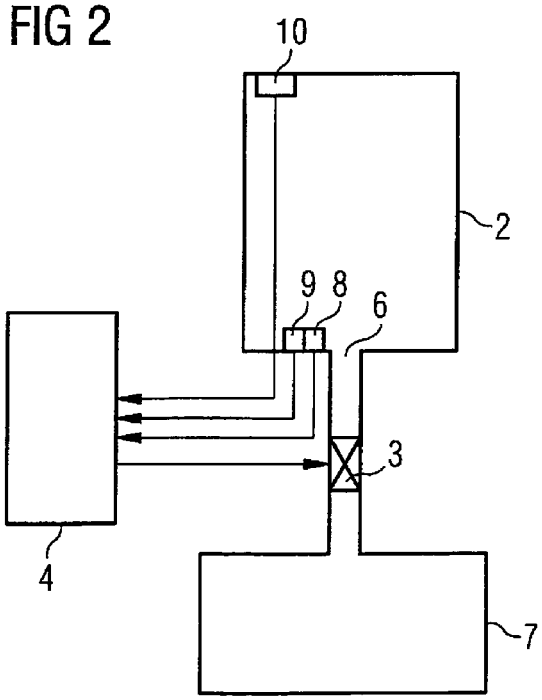
Figure 3:
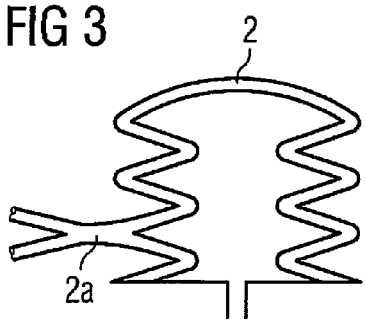
Figure 4:
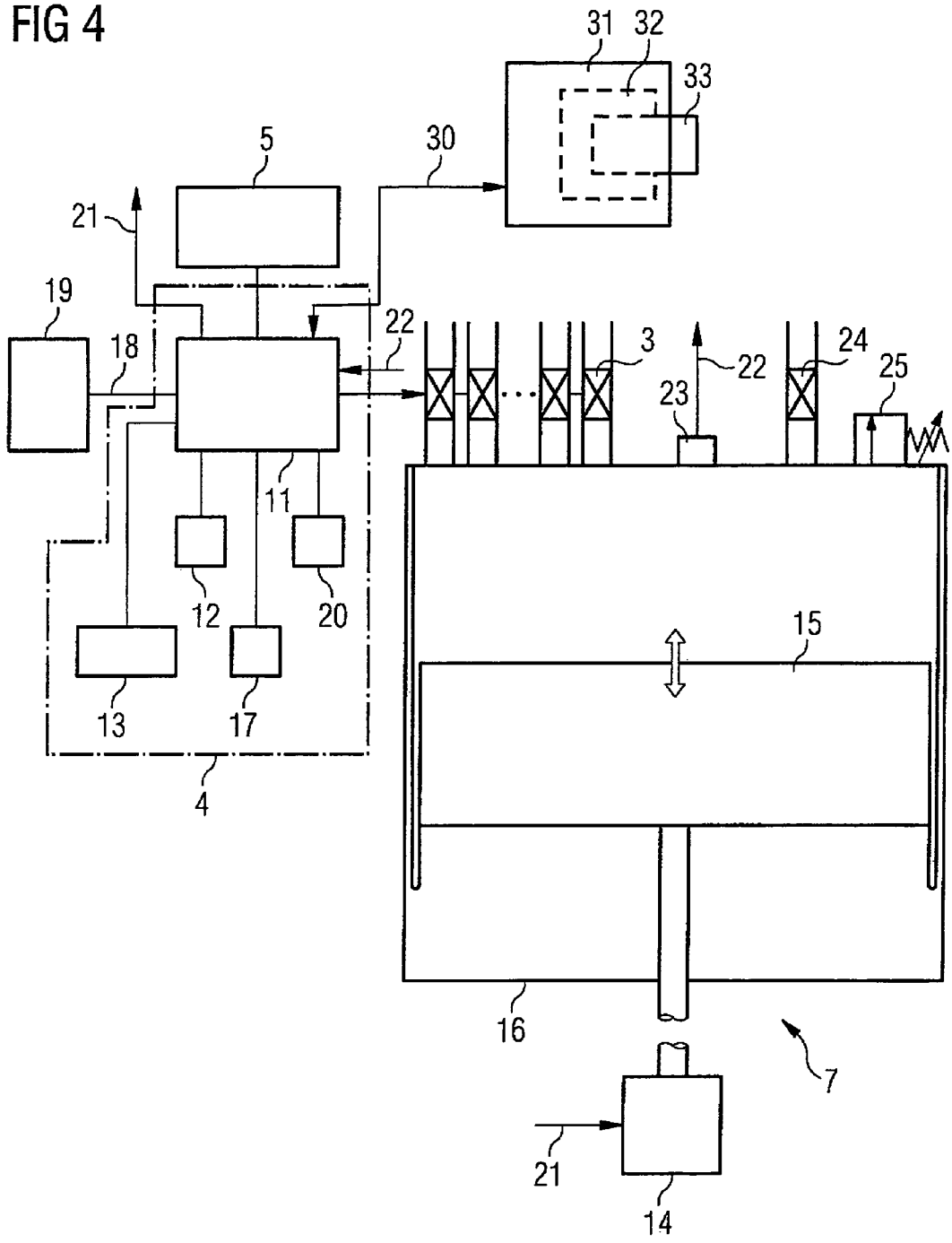
Figure 5A:
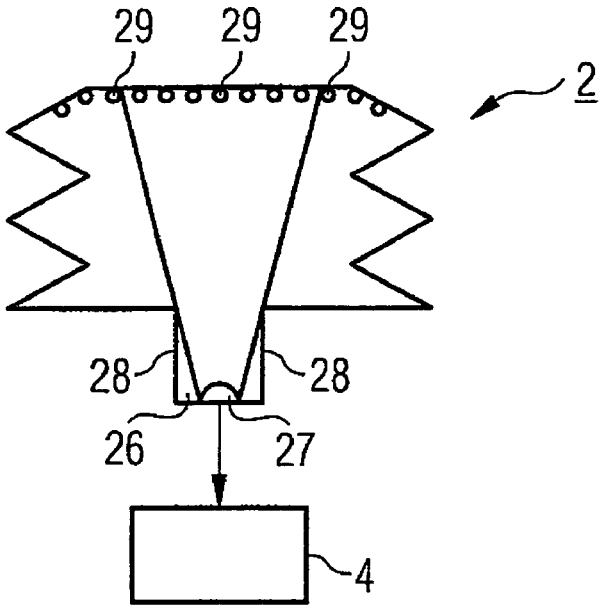
Figure 5B:
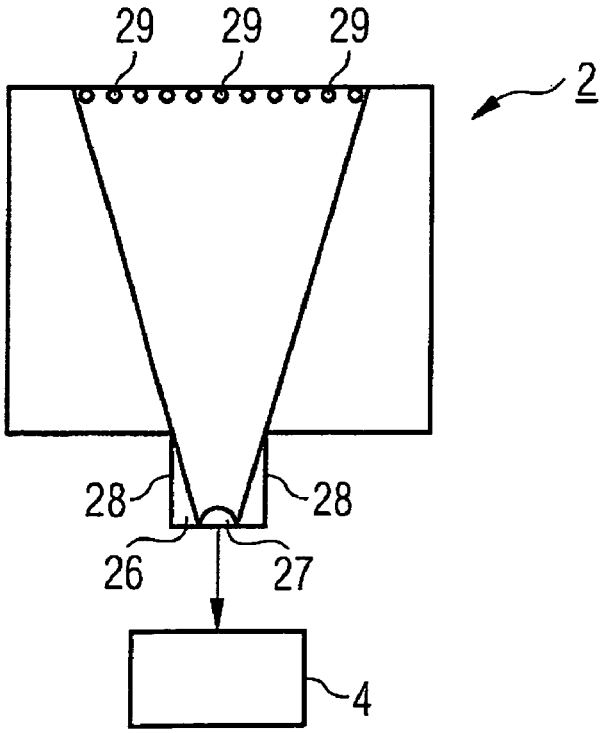
Figure 6:
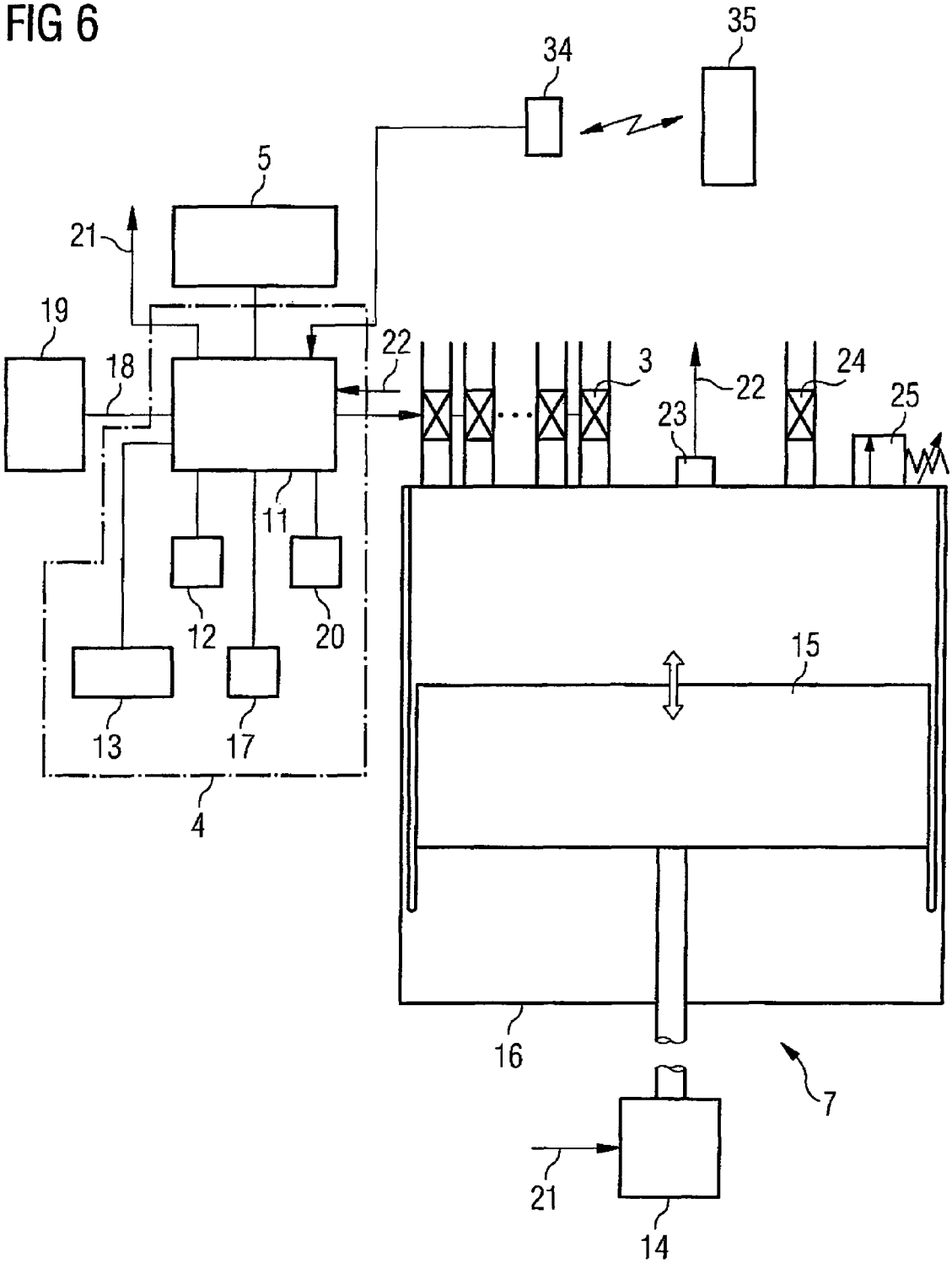

Further advantageous characteristics of the invention are evident from the explanation thereof by way of example and with reference to the figures, in which:

FIG. 1 shows a schematic perspective view of a mattress used in the lying-down means according to the invention, FIG. 2 shows an illustration for explanation of the functioning of lying-down means according to the invention, FIG. 3 shows a schematic view for clarification of a preferred form of construction of an air chamber, FIG. 4 shows a further illustration for explanation of the functioning of lying-down means according to the invention, FIG. 5 shows diagrams of an example of embodiment for measuring the height of an air chamber and FIG. 6 shows an illustration of an alternative form of embodiment of lying-down means according to the invention.

FIG. 1 shows a schematic perspective view of a mattress used in the lying-down means according to the invention. The illustrated mattress 1 has a plurality of air chambers 2 in grid arrangement. Each of these air chambers has a square, rectangular or round base area. In the case of a square base area each chamber has, for example, a length and a width in the region between 4 and 10 centimetres. The height of each air chamber can be set in dependence on the supplied air quantity, for example in the region between 6 and 12 centimetres. The total length of the mattress is, for example, 200 centimetres and its width 100 centimetres.

Each of the air chambers 2 of the mattress 1 can be individually pumped up with air so that for each individual one of the air chambers the air pressure prevailing there and the height are individually settable. This individual pumping of an air chamber is illustrated in connection with FIG. 2, which shows an illustration for clarification of the functioning of lying-down means according to the invention.

The air chamber 2 illustrated there has an air connection 6 connected by way of a valve 3 with a compressed air source 7. The valve 3 is opened and closed by control signals provided by a control unit 4. The control unit 4, which comprises a processor, generates the said control signals in dependence on valve control data, which are stored in a mattress profile memory 12, with additional consideration of sensor output signals applied thereto.

The air chamber 2 illustrated in FIG. 2 has, similarly to all other air chambers of the mattress, a pressure sensor 8, a height sensor 9 and a position sensor 10. The output signals of the said sensors are fed to the control unit 4 and taken into consideration by the processor thereof in the determination of the valve control data fed to the valves. Through the valve control data the valves are opened or closed and thus made passable or blocked. It is optionally also possible to manage with less position sensors in order to detect the lying position of the person lying on the mattress. A single position sensor located in one of the air chambers is possibly sufficient for that purpose.

The air pressure prevailing in the respective air chambers can be monitored, by evaluation of the sensor signals supplied by the pressure sensor 8, with regard to whether or not it corresponds with a desired mattress profile. In addition, the air pressure in the respective air chamber can be monitored, by evaluation of the output signals of the pressure sensor 8, so that it does not exceed a predetermined permissible maximum pressure. It is thereby ensured that an air chamber cannot undesirably burst and place at risk the person lying on the mattress. In addition, in order to avoid bursting of air chambers of the mattress, the air of the air pressure source 7 can also be limited by means of a mechanical excess pressure valve 25 (see FIG. 4), wherein the excess pressure valve is, for example, integrated in the duct connecting plate for the air chamber feeds. Additionally or alternatively it is also possible to provide for that purpose an electric control valve 24 controlled in drive by the control unit 4 (see FIG. 4).

Through evaluation of the sensor signals supplied by the height sensor the height of the respective air chamber can be monitored with regard to whether it corresponds with or has to be adapted to the currently set mattress profile. The height measurement is carried out in that, for example, a reflective layer is applied to the underside of the upper boundary wall of the air chamber and the spacing of the reflective layer from the height sensor 9 is detected.

Through evaluation of the control signals supplied by the position sensors 10 it can be determined whether the person lying on the mattress lies on their stomach, back or side and a mattress profile associated with the respective position of lying can be set. For this positional determination, for example, various signal transmitters are fastened, such as sewn, in the region of the upper edge of the pyjama pants of a person sleeping on the mattress. A first transmitter is located in the region of the back, a second transmitter in the region of the stomach, a third transmitter on the lefthand side and a fourth transmitter on the righthand side. If these signal transmitters are disposed in the vicinity of one of the position sensors 10, then the respective position sensor delivers to the control unit 4 an individually characteristic identifying signal on the basis of which the control unit recognises, with use of data stored in a lying-down profile memory, whether the person lying on the mattress lies on their stomach, back, lefthand side or righthand side. If, for example, the person lies on their back, then merely the signal transmitter arranged in the region of the back causes a report, by way of the position transmitter 10 arranged in the vicinity, to the control unit 4. All other signal transmitters are spaced so far from the respective closest position signal that the further position sensors do not deliver signals. Consequently, in this case the control unit 4 sets a mattress profile corresponding with a person sleeping on their back. For this purpose the control unit 4 uses data stored in a mattress profile memory.

FIG. 3 shows a schematic view for illustration of a preferred form of construction of an air chamber. This is realised in the form of a bellows consisting of a soft plastics material. If air is pumped into this air chamber from the underside then the folds extend in the sense that the height of the air chamber enlarges. If, thereagainst, air is let out of the air chamber then the bellows collapses again so that the height of the air chamber reduces. Mutually adjacent bellows of the mattress 1 are—as illustrated by the contact member 2*a* depicted in FIG. 3—interconnected by a vulcanisation process. This connection of mutually adjacent bellows is located in the centre or lower region of the respective bellows. Setting of the desired height of a bellows is thereby not impaired. For reasons of clarity the sensors disposed in the air chamber 2 are not illustrated in FIG. 3.

Alternatively to the form of construction illustrated in FIG. 3 the air chambers can also be realised in the form of a telescopic piston-cylinder connection.

FIG. 4 shows a further illustration for explanation of the functioning of lying-down means according to the invention. In this figure, in particular, the control unit 4 and the air source 7 are shown in more detail.

The air source comprises a piston housing 16 within which a piston 15 is reciprocatingly movable. On upward movement of the piston 15 air is urged in the direction of the valves 3 of the air chambers. If the respective valve is open, then the air urged through the valve is pumped into the respective air chamber. On downward movement of the piston air can—insofar as the respective valve is open—be let out of the respectively associated air chamber. The movement of the piston 15 is produced by a linear motor 14 which in turn is acted on by control signals fed thereto by the control unit 4 via a motor control line 21. The control unit 4 ensures that a valve for pumping in or letting out air is open during the upward or downward movement of the piston only if the pressure in the respective air chamber corresponds with the air pressure prevailing in the pump chamber of the piston housing. For this purpose a pressure sensor 23 is also provided in the region of the piston housing, the output signal of the pressure sensor being supplied to the control unit 4 by way of a line 22.

The advantage of a design of the air source 7 of that kind consists in that the introduction of the air into the air chambers of the mattress and the letting out of air from the air chambers of the mattress takes place without noise. This is attributable to the fact that the piston 15 has to move in the piston housing 16 only very slowly, since a change in the air pressure in the air chambers is to take place not abruptly, but slowly. This has the advantage that change in the air pressure takes place imperceptibly for the person lying on the mattress.

The control of the valves is carried out—as was already explained above—by control signals, which are made available by the control unit 4, for each of the valves and thus for each air chamber individually.

The control unit 4 comprises a processor 11, a mattress profile memory 12, a keyboard 13 as input means, a records memory 17 and a lying-down profile memory 20. The processor 11 is connected with a display 5 as well as with, by way of an on-line connection 18, a remotely arranged central processor 19. The latter is located in, for example, a hospital, a medical practice or a sleep research institute. In addition, the processor 11 is connected with the linear motor 14 by way of the motor control line 21. Also available to the processor—which is not illustrated in FIG. 4, but apparent from FIG. 2—are the sensor signals derived from the pressure sensors 8, height sensors 9 and position sensors 10. In addition, the control unit 4 is connected with a data carrier receptacle 31 by way of a line 30. Arranged in this data carrier receptacle are writing and reading means 32, by way of which a data carrier 33 inserted into the data carrier receptacle is writable and by way of which a data carrier 33 inserted into the data carrier receptacle is readable. The data carrier 33 is a memory card.

The illustrated means has several working modes, which can be initiated by way of the keyboard 13.

A first working mode consists in selection of a desired mattress profile by means of the control keyboard 13 and setting it by means of the processor 11. For this purpose valve control data corresponding with a plurality of different mattress profiles were filed beforehand in the mattress profile memory 12. Each of these data sets is selectable by way of the control buttons 13 in the sense of selection of a desired mattress profile. The processor 11 addresses, as a reaction to the input control commands, the mattress profile memory 12 in such a manner that the respectively desired data set is read out of the mattress profile memory 12 and controls the linear motor 14 and the valves of the air chambers in such a manner that the desired mattress profile is set. Each of the mentioned data sets in that case contains, with respect to each individual one of the air chambers, valve control data or items of information about the pressure and height.

If the desired mattress profile has been set, the processor 11 then monitors maintenance of this setting with consideration of the input signals supplied thereto and initiates, if needed, adaptations by appropriate drive control of the linear motor 14 and the valves 3 of the air chambers. In addition, the processor 11 monitors the pressure in each individual air chamber in the manner that a permissible maximum pressure fixed in advance is not exceeded. If the processor 11 recognises that the air pressure in one of the chambers corresponds with the maximum permitted pressure then it opens the associated valve in order to let air out of this chamber.

In order to prevent the air chambers from completely relaxing when the person lying on the mattress rises, a limiter element can be provided in each air chamber. This limiter element has the effect that a predetermined maximum permissible height of the air chambers is not exceeded. Damage or even destruction of the air chambers is thereby avoided. If the air chambers are realised as bellows, the limiter element can be, for example, a cord.

A bias pressure is preferably applied to each air chamber in the unloaded state of the mattress. Regulation to a desired mattress profile is carried out only when a person lies on the mattress again.

A second operating mode consists in initiating rundown of a predetermined sequence of mattress profiles by means of the control keyboard. This sequence of mattress profiles was established beforehand and serves for repeated redisposition of the person lying on the mattress. It can thereby be achieved that the spinal column of the person lying on the mattress is, for example, moved in predetermined manner during sleep so that the said person does not have back pains after awakening. In the case of sick patients hardly able to move themselves it can be achieved by repeated change in the mattress profile that the pressure on specific body parts, for example the heels or shoulders, does not remain constantly high over a lengthy period of time. Occurrence of a bedsore can thereby be avoided or at least delayed in its onset. In addition, in this operating mode the input signals supplied by the sensors to the compressor 11 are additionally taken into consideration so as to maintain the respectively desired mattress profile and adapt it to the body of the person lying on the mattress.

A third working mode consists of automatically setting, by evaluation of the lying position of the person lying on the mattress, a mattress profile adapted to the detected lying position. For this purpose data corresponding with mattress profiles adapted to the respective lying position were stored in advance in the resting profile memory 12. One possible lying position is the stomach position, a second lying position is the back position, a third lying position is lying on the lefthand body side, and a fourth lying position is lying on the righthand body side. The respectively associated mattress profiles are of such a kind that in each instance the person lying on the mattress is supported in a comfortable manner kind to the spinal column.

Detection of the lying position is carried out by evaluation of the output signals of the position sensors 10. These cooperate with signal transmitters fastened, for example sewn, in the pyjama pants of the person lying on the mattress. Thus, a signal transmitter of that kind is respectively provided in the back region, in the stomach region, on the lefthand side and on the righthand side of the pyjama pants, wherein these signal transmitters issue signals distinguishable from one another. The signals are, if the respective signal transmitter is located sufficiently close to one of the position sensors 10, detected by this and passed on to the control unit 4. If, for example, the person lying on the mattress lies on their back, then exclusively the position sensor 10 located in the back region of the pyjama pants is sufficiently close to the signal transmitter, so that merely this position sensor passes on a signal to the control unit 4. As a reaction to reception of this signal the control unit addresses the lying-down profile memory 20 in such a manner that those data corresponding with the detected lying position are read out of the memory. These data are employed by the control unit 4 to make available suitable drive control signals for the linear motor 14 and the valves of the air chambers 2. The lying-down profile memory 20 and the mattress profile memory 12 can optionally be realised as a single memory.

The aforesaid forms of operation can also be combined with one another, whereby adaptation of the mattress profile to the body of the person lying on the mattress is further enhanced.

According to the present invention valve control data corresponding with a mattress profile can be transferred to the data carrier 33 and stored thereon. For example, after actuation of a button of the operating unit 13 there is shown on the display 5 a list which offers several different mattress profiles for selection. The user can select one or more of the offered mattress profiles by means of the cursor buttons of the operating unit 13 and confirm the effected selection by actuation of an input button. The processor 11 thereupon controls transmission of the valve control data, which correspond with the selected mattress profile or the selected mattress profiles, by way of the line 30 to the data carrier 33 on which they can be stored by way of the write/read means 32.

The user can thereupon take with him or her the data carrier with the data stored thereon and use it, for example in a hotel or hospital in which lying-down means with the features according to the invention are similarly located, for the purpose of transferring the data, which are stored on the data carrier, to the mattress profile memory of the lying-down means located there. The user is thereby saved time and trouble which would be necessary in order to set the individual mattress profile of the user in the mentioned hotel or hospital.

In addition, a data carrier on which valve control data corresponding with a user profile were stored elsewhere can also be inserted into the data carrier receptacle 31. After this insertion a button of the operating unit 13 is actuated in order to cause display of a list on the display 5. In this list there are offered for selection one or more mattress profiles of which the associated valve control data are stored on the data carrier. The user can select one or more of the offered mattress profiles by means of the cursor buttons of the operating unit 13 and confirm the effected selection by actuation of an input button. The processor 11 thereupon controls reading of the valve control data, which correspond with the selected mattress profile or the selected mattress profiles, from the data carrier 33 and transmission thereof by way of the line 30 to the mattress profile memory 12.

In addition a distinguishing criterion, for example a serial number or an alphanumeric identification, can also be associated with the mattress profile by means of the operating unit 13. The mattress profile distinguishing data associated with the distinguishing criterion are stored on the data carrier together with the valve control data corresponding with the mattress profile. The advantage of use of distinguishing criteria of that kind consists in that several persons can use one and the same data carrier and after insertion of the data carrier into the data carrier receptacle can selectively transfer the valve control data, which correspond with the desired mattress profile, to the mattress profile memory of lying-down means which are present.

Moreover, a sequence of mattress profiles or associated valve control data can also be stored on the data carrier and read out again from there. After reading of these data into the mattress profile memory of lying-down means the said sequence of mattress profiles can be started so that a person lying on the mattress is repeatedly repositioned in the sense of the said sequence.

An advantageous embodiment of the invention consists in representing data, which correspond with the mattress profiles, in suitable form on the display 5. The user has the possibility of undertaking, by way of the display illustration, selective changes, which correspond with his or her individual preferences, to the mattress profiles. Also in this area are, for example, a massage and a ventilation by selective movement up and down of individual chambers.

Another advantageous embodiment of the invention consists in providing a records memory 17 in which, for example, the set mattress profiles are recorded for the duration of a night. The recorded data can subsequently be represented on the display 5. This allows conclusions with respect to whether the sleeping person predominantly sleeps on their stomach, back or side, whether he or she frequently or seldom turns during sleep, etc.

Evaluation of the recorded data can alternatively also be carried out by means of a remotely located central computer 19 coupled with the control unit 4 by way of an on-line connection 18. This central computer is in, for example, a hospital. It is thereby made possible for a doctor to analysis the sleeping habits of one of his or her patients and if needed to also selectively remotely vary set mattress profiles in that the doctor transmits to the control unit 4 by way of the on-line connection 18 new data corresponding with changed mattress profiles.

Alternatively thereto the data stored in the records memory 17 can also be transferred to the data carrier 30. This data carrier can be taken to the central computer 19. There the data stored on the data carrier can be transferred to the central computer and evaluated by this.

FIG. 5 shows diagrams of an example of embodiment for measuring the height of an air chamber in which the height sensor has an image recording element. According to this example of embodiment the base of the air chamber 2 is provided with a recess 26 with the image recording element 27 arranged in the lower region thereof. This image recording element 27 is directed upwardly in the direction of the upper side of the air chamber. The pick-up region of the image recording element 27 is laterally bounded by the side walls 28 of the recess 26. A plurality of marking points 29 is provided at the inner surface of the upper side of the air chamber. If the air chamber is filled with only a small amount of air, the height of the air chamber is low and only a comparatively small number, which is dependent on the height of the air chamber, of the marking points 29 is contained in the pick-up region of the image recording element 27. This state is illustrated in FIG. 5*a*. If, thereagainst, the air chamber is completely filled with air, the height of the air chamber is large and all marking points are contained in the pick-up region of the image recording element. This state is illustrated in FIG. 5*b*. The output signal of the image recording element 27 is transmitted to the control unit 4. This determines from the received signal the number of detected marking points 29 respectively present and then from that the height of the air chamber.

FIG. 6 shows an illustration of an alternative form of embodiment of lying-down means according to the invention. This alternative form of embodiment differs from the form of embodiment shown in FIG. 4 merely in that it has, as data interface, a Bluetooth or WLAN interface 34 which can be brought into contact with a mobile communications apparatus 35. This mobile communications apparatus 35 is preferably a mobile telephone, which similarly has a Bluetooth or WLAN interface. The mobile communications apparatus is equipped with control software which allows interrogation of valve control data from the lying-down means by way of the interface 34 and issue of valve control data to the lying-down means by way of the interface 34.

The valve control data called up by way of the interface 34 are stored in the memory of the mobile communications apparatus and can be transferred from this memory by way of the Bluetooth interface or by way of a public radio-telephone connection to lying-down means which, for example, are located in a hotel and which are similarly equipped with the features according to the invention.

According to an advantageous development the control software can also be designed in such a manner that the lying-down means or the filling state of the air chambers thereof is controllable by means of the mobile communications apparatus.

REFERENCE NUMERAL LIST

1 mattress
2 air chamber
2*a* contact member of an air chamber
3 valve
4 control unit
5 display
6 air connection
7 air source
8 pressure sensor
9 height sensor
10 position sensor means, position sensor
11 processor
12 mattress profile memory
13 input means; keyboard
14 linear motor
15 piston
16 piston housing
17 records memory
18 on-line connection
19 central computer
20 lying-down profile memory
21 motor control line
22 line to the control unit
23 pressure sensor
24 electric safety valve
25 mechanical excess pressure valve
26 recess
27 image recording element
28 side walls
29 marking points
30 line
31 data carrier receptacle
32 write/read means
33 data carrier
34 Bluetooth or WLAN interface
35 mobile communications apparatus

The invention claimed is:

1. Lying-down means comprising a mattress with a plurality of air chambers in grid arrangement and each having a respective air connection, a plurality of controllable valves each associated with a respective one of the air chambers, a mattress profile memory in which valve control data corresponding with a mattress profile are stored for each of the air chambers and a control unit which actuates the valves in dependence on the valve control data, the control unit is connected by way of a line with a data interface, by way of which for its part it is connectable in a wire-free manner with a data carrier, the data interface comprising:

a data carrier receptacle, into which a data carrier is insertable, means for writing a data carrier, which is inserted in the data carrier receptacle, with valve control data and means for reading valve control data stored on a data carrier inserted into the data carrier receptacle, wherein the data carrier receptacle is a memory card receptacle and the data carrier is a memory card.

2. Lying-down means according to claim 1, further comprising input means, through the actuation of which valve control data corresponding with the mattress profile are selectable.

3. Lying-down means according to claim 2, wherein the input means are further provided for input of mattress profile distinguishing data.

4. Lying-down means according to claim 1, further comprising a display on which one or more different mattress profiles are offered for selection and that one or more of these mattress profiles are selectable by way of the input means for the purpose of issue of the associated valve control data in wire-free form by way of the data interface.

5. Lying-down means according to claim 1, further comprising a display on which one or more different mattress profiles are offered for selection and that one or more of these mattress profiles are selectable by way of the input means for the purpose of reading the associated valve data.

6. Lying-down means comprising a mattress with a plurality of air chambers in grid arrangement and each having a respective air connection, a plurality of controllable valves each associated with a respective one of the air chambers, a mattress profile memory in which valve control data corresponding with a mattress profile are stored for each of the air chambers and a control unit which actuates the valves in dependence on the valve control data, wherein the control unit is connected by way of a line with a data interface, by way of which for its part it is connectable in a wire-free manner with a mobile communications apparatus having a memory, wherein the data interface is a WLAN interface, wherein the control unit has a processor which is configured to control the transmission of valve control data via the line being foreseen between the processor and the data interface, and wherein the mobile communication apparatus is equipped with control software which allows interrogation of valve control data from the lying down means by way of the WLAN interface and issue of valve control data to the lying down means by way of the WLAN interface.

7. Lying-down means comprising a mattress with a plurality of air chambers in grid arrangement and each having a respective air connection, a plurality of controllable valves each associated with a respective one of the air chambers, a mattress profile memory in which valve control data corresponding with a mattress profile are stored for each of the air chambers and a control unit which actuates the valves in dependence on the valve control data, wherein the control unit is connected by way of a line with a data interface, by way of which for its part it is connectable in a wire-free manner with a mobile communications apparatus having a memory, wherein the data interface is a Bluetooth interface, wherein the control unit has a processor which is configured to control the transmission of valve control data via the line being foreseen between the processor and the data interface, and wherein the mobile communication apparatus is equipped with control software which allows interrogation of valve control data from the lying down means by way of the Bluetooth interface and issue of valve control data to the lying down means by way of the Bluetooth interface.

* * * * *